United States Patent [19]

Baranowski et al.

[11] 3,949,760

[45] Apr. 13, 1976

[54] MOVEMENT-COMPENSATING BRASSIERE

[75] Inventors: Joyce Baranowski, Bridgeport; Stanley Malinowski, Trumbull, both of Conn.

[73] Assignee: Warnaco Inc., Bridgeport, Conn.

[22] Filed: Nov. 18, 1974

[21] Appl. No.: 524,407

[52] U.S. Cl. ..... 128/425; 128/483

[51] Int. Cl.[2] ..... A41C 3/00

[58] Field of Search ..... 128/425, 428, 483, 485, 128/494, 495, 496, 498, 499

[56] References Cited

UNITED STATES PATENTS

| | | | |
|---|---|---|---|
| 2,881,764 | 4/1959 | Verreault | 128/483 |
| 2,897,822 | 8/1959 | Amyot | 128/494 X |
| 3,185,157 | 5/1965 | Gingras | 128/483 |
| 3,545,445 | 12/1970 | Freedman et al. | 128/495 X |

*Primary Examiner*—Werner H. Schroeder
*Assistant Examiner*—Moshe I. Cohen
*Attorney, Agent, or Firm*—Amster & Rothstein

[57] ABSTRACT

A brassiere is provided in which left and right bust cups are fixed at their circumferentially outermost sides to body-encircling side panels which fasten in the normal manner. Front and rear overlapping diaphragm panels, fashioned of stretchable material, extending across the front of the brassiere, are stitched at both of their left and right ends to the side panels and are stitched together at their substantially straight lowermost edges. The diaphragm bands include two generally upwardly concave segments, each of which intersect at an apex located approximately centrally of the brassiere. The bottom of the right bust cup is stitched along its lower edge to the upper edge of the right upwardly concave segment of the front diaphragm band. The bottom of the left bust cup is stitched along its lower edge to the upper edge of the left upwardly concave segment of the rear diaphragm band. The bust cups and diaphragm bands are otherwise unattached thereby permitting individual compensation by the bust cups for non-symmetrical movements of the wearer.

5 Claims, 3 Drawing Figures

MOVEMENT-COMPENSATING BRASSIERE

The present invention relates generally to brassieres, and in particular to a brassiere wherein the individual, nonsymmetrical movement of the breasts of the wearer are individually compensated for by the brassiere.

Various brassieres have been available in the market which attempt to perform the normal function of a brassiere of supporting and shaping the bust of the wearer while compensating for the normal, non-symmetrical strains placed on the brassiere by the normal, non-symmetrical movements of the wearer.

Solutions to the aforementioned problem include attempting to provide some compensation for non-symmetrical strain induced on the brassiere bust cups by only partially rigidly attaching the bust cups to one another at or near the center line of the brassiere. The required additional stability for the bust cups in such a brassiere is provided by a single band formed of stretchable material which underlies and is fixed to the bust cups. Such a solution is unsatisfactory in that the desired freedom of movement of the individual bust cups coupled with the required uplift and support is not provided by such an arrangement.

An alternate attempt at a solution has included attachment of bust cups to one another through use of overlapping stretchable panels which movably fix the bust cups to one another and which are, in turn, fixed to respective side panels. Such an attempted solution is likewise unsatisfactory as the desired relative freedom of movement between the two bust cups is not provided owing to their being both fixed to two elastic panels.

A still further attempt at a solution to the instant problem of providing support and uplift while compensating for non-symmetrical strain caused by normal, non-symmetrical movement has involved attachment of two bust cups to each of two bottom panels and connecting the bottom panels one to the other through the use of stretchable, overlapped panels. The overlapped panels are, in turn, stitched to the inner sides of respective bust cups and not fixed to the adjacent bust cup. Instead, the overlapped panels are fixed to the inner edge of the bottom panel of the adjacent bust cup, substantially inward of the center line of said adjacent bust cup. Such an attempt at a solution to the problem outlined hereinbefore is, at best, only partially successful. While the described arrangement does, indeed, provide a certain measure of support for the bust cups, the point of attachment of the insert to the bust cup to which it is attached, as well as the location of the anchor point relative to the adjacent bust cup, does not provide the required freedom of movement in order to adequately compensate for the non-symmetrical strain which would be imposed upon such an arrangement by virtue of the normal, everyday non-symmetrical movements of a wearer of such a brassiere.

It is an object of the present invention to provide a brassiere wherein the individual bust cups are sufficiently firmly mounted relative to the body of the wearer to provide the required uplift and support and yet are sufficiently independent from one another to permit compensation of the brassiere to accommodate for non-symmetrical strain imposed thereon while providing a great deal of comfort to the wearer.

It is a more particular object of the present invention to provide a brassiere wherein the bust cups themselves may be made of non-elastic material, are not directly, or indirectly through intermediate materials, connected to one another but, instead, are individually fixed to body encircling side panels at one edge, supported from above by the normal support straps and fixed at their lower edge to an elastic diaphragm band and are fixed to each other in no other way, the diaphragm bands including a sufficiently great unsupported length to permit compensation of individual non-symmetrical movements of the respective bust cups affixed thereto while still providing the required uplift and support.

In accordance with a specific embodiment of the present invention, a brassiere is provided comprising left and right bust cups and left and right side body panels. Each of the side body panels is fixed to one of the bust cups. The brassiere includes inner and outer diaphragm bands underlying both of the bust cups. Each of the diaphragm bands is fixed at each end thereof to a respective side body panel at the proximate circumferential location wherein the side body panel if fixed to the respective bust cup. The inner diaphragm band is fixed to a first one of the bust cups and is free of the second one of the bust cups. The outer diaphragm band is fixed to the second one of the bust cups and is free of the first one of the bust cups.

The above brief description as well as further objects, features and advantages of the present invention will be more fully understood by reference to the following detailed description of the presently preferred but nonetheless illustrative embodiment in accordance with the present invention, when taken in conjunction with the accompanying drawing, wherein.

Figure 1:
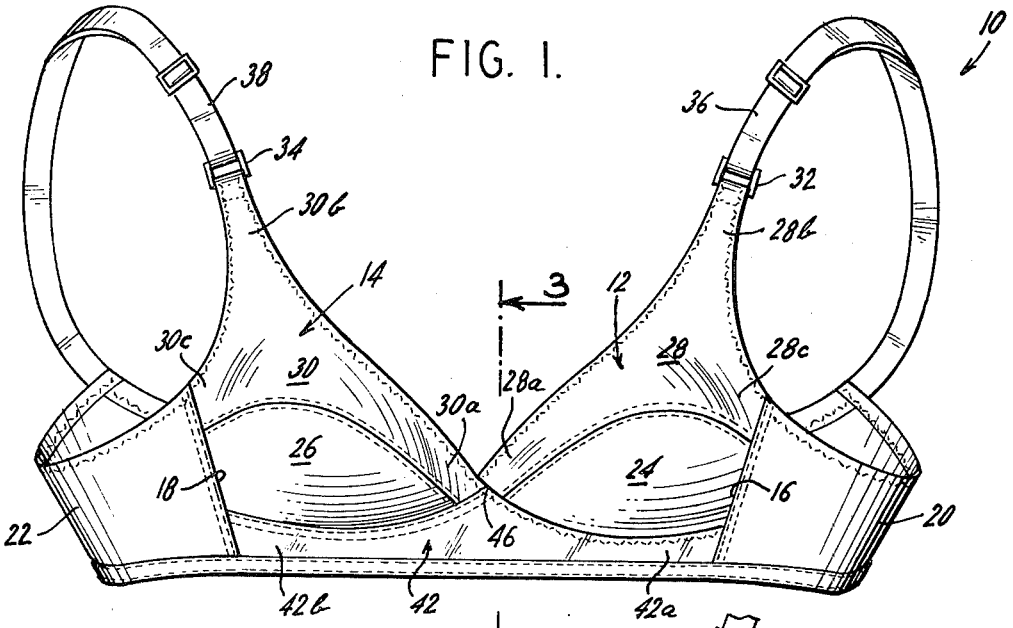
FIG. 1 is a front perspective view of an illustrative form of the present invention.

Referring now specifically to the drawing, and first to FIG. 1, in accordance with one illustrative embodiment demonstrating objects and features of the present invention, there is provided a brassiere, generally designated by the reference numeral 10, and which includes left and right bust cups generally designated by the reference numerals 12, 14 respectively.

Throughout the description of the preferred embodiment, references to "left" and "right+ will be from the standpoint of the wearer of the brassiere 10.

The circumferentially outermost edges of the bust cups 12, 14 are fixed to the front attachment edges 16, 18, respectively, of left and right, side, body-encircling panels 20, 22.

At the rear of the brassiere 10, the left and right side body panels 20, 22 include fastening edges and rear fastening means of conventional construction such as the wellknown hooks and eyes common to most brassieres. The side body panels 20, 22 may be fashioned of any convenient material and, in the preferred embodiment, are fashioned of a stretchable, elastic material in order to aid in compensating for the movement of the wearer of the brassiere while providing the required comfort and support.

Each of the left and right bust cups 12, 14 includes a lower section 24, 26 co-joined with an upper section 28, 30, by conventional stitching or the like, to form the finished bust cup.

The upper left and upper right bust cup sections 28, 30 are generally shaped like a non-symmetrical Y with the central, longer leg of the Y 28*a*, 30*a* of each bust cup 12, 14 being inclined toward the mid-point or center-line of the brassiere 10 and being generally downwardly convex. The arms of the Y shape of the upper left and right bust cup sections 28, 30 are unequal in length with the longer sections 28*b*, 30*b* being generally upstanding and the shorter arms 28*c*, 30*c* curving downwardly and being fastened at their circumferentially outermost edges to the attachment edges 16, 18 of the left and right side body panels 20, 22.

The generally upstanding legs 28*b*, 30*b* of the upper left and upper right bust cup sections 28, 30 are fixed, by any convenient means such as fasteners 32, 34 to support straps 36, 38 which are, in turn, fixed to the back of the left and right side body panels 20, 22 in the conventional manner.

The lower sections 24, 26 of the left and right bust cups 12, 14 are generally oval-shaped and are fastened to the upper sections 28, 30, as noted hereinbefore, by any convenient means such as by conventional stitching. The left and right, circumferentially outermost edges of the lower sections 24, 26 of the left and right bust cups 12, 14 are, in a manner similar to the circumferentially outermost edges of the upper sections 28, 30, fixed as by stitching or the like to the attachment edges 16, 18 of the left and right side body panels 20, 22.

Figure 2:
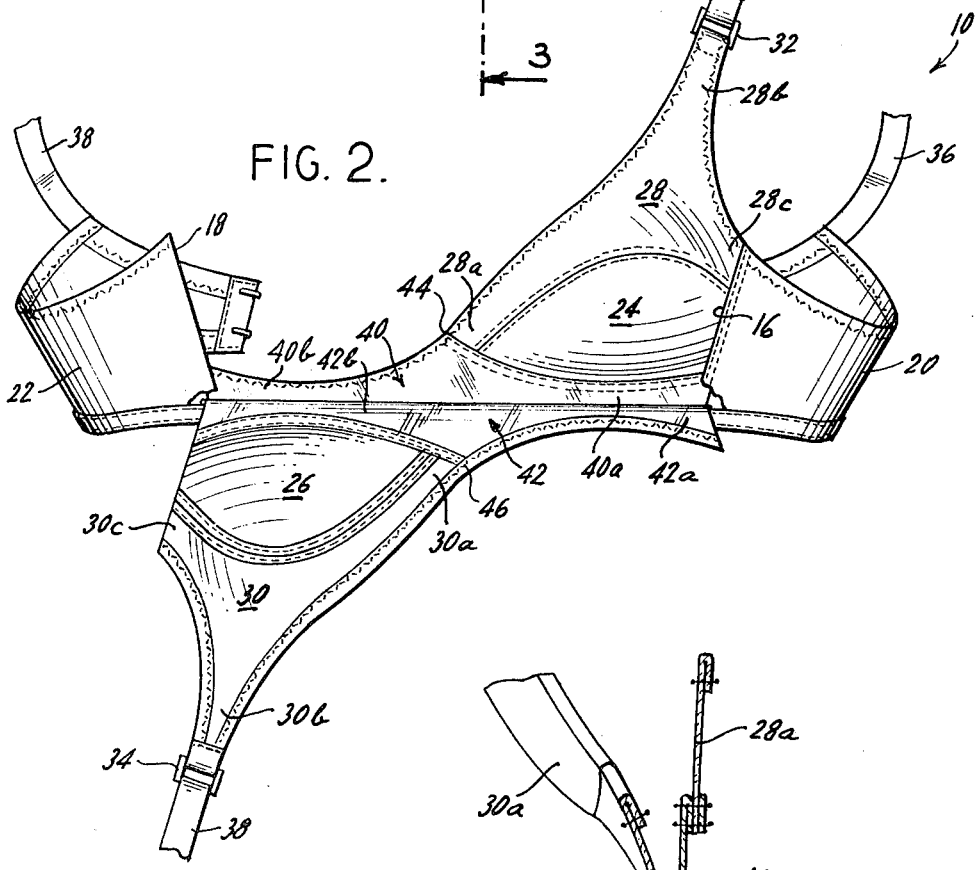
FIG. 2 is an exploded fragmentary front perspective view of the invention of FIG. 1 with parts broken away showing the right bust cup and associated outer diaphragm band detached from the respective side body panels to which they are normally attached; and, FIG. 3 is an enlarged, fragmentary sectional view taken substantially along the line 3—3 of FIG. 1 and looking in the direction of the arrows.

The circumferentially innermost edges of the upper and lower sections of the left and right bust cups 12, 14 are not directly connected to either of the left or right side body panels 20, 22; and, as may be seen by reference to FIG. 2, are not directly connected to one another as described in greater detail hereinafter.

Inner and outer (or front and rear) diaphragm bands 40, 42 extend across the entire front of the brassiere 10 and are both fixed at both of their circumferentially outermost (left and right) edges to the attachment edges 16, 18 of the left and right side body panels 20, 22.

Figure 3:
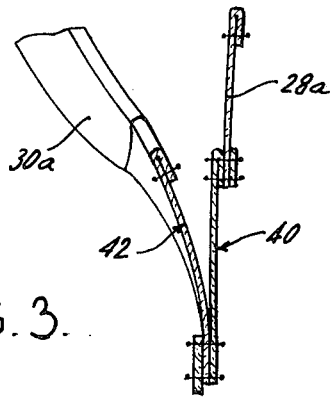

Each of the inner and outer diaphragm bands 40, 42 may be fashioned of any convenient stretchable material and each includes a generally straight lower edge. Both lower edges are together as may be seen by reference to FIGS. 1 and 3.

Each of the inner and outer diaphragm bands 40, 42 is formed from two left and right segments 40*a*, 40*b* and 42*a*, 42*b* which are generally concave upward at their upper or top edge. Each of the segments 40*a*, 40*b* and 42*a*, 42*b*, intersect on the respective inner and outer diaphragm bands 40, 42 at respective inner and outer diaphragm apices 44, 46 (see FIG. 2).

The inner and outer diaphragm bands 40, 42 (as well as virtually the entire brassiere 10) are generally symmetrical about a center line with the apex 44 of the inner diaphragm band 40 being located to the right of the center line and the apex 46 of the diaphragm 42 being located to the left of the center line.

The upwardly concave upper edge of the left segment 40*a* of the inner diaphragm band 40 is fixed, by conventional means such as stitching or the like, to the lower edge of the left bust cup 12 (see FIG. 2). The right segment 40*b* of the inner diaphragm band 40 is not directly connected to the right bust cup 14 in any manner.

The upwardly concave upper edge of the right segment 40*b* of the inner diaphragm band 40 is contoured, and the left segment 40*a* of the inner diaphragm band 40 is so attached to the left bust cup 12 that the circumferentially inner edge of the left upper section 28 of the bust cup 12 forms a smooth, continuous curve with the upper edge of the right segment 40*b* of the inner diaphragm band 40 (see FIG. 2).

A similar construction and arrangement exists between the outer diaphragm band 42 and the right bust cup 14 as described hereinbefore with respect to the inner diaphragm band 40 and the left bust cup 12; and, for the sake of brevity, shall not be described in detail herein, reference being had to FIGS. 1 and 2 for the constructional details of the aforementioned interconnection.

It is to be emphasized, however, that the outer diaphragm band 42 is directly connected to the right bust cup 14, by the underside of the bust cup 14 being sewn to the upper edge of the upwardly concave right segment 42*b* of the outer diaphragm band 42, and is not in any way directly connected to the left bust cup 12.

It should be emphasized in the present invention that the left and right bust cups 12, 14 are constructed and arranged to provide a substantial amount of uplift and support by virtue of their particular manner of attachment and interconnection to the structures of the present invention.

Specifically, as noted hereinbefore, the generally upstanding sections 28*b*, 30*b* of the upper sections 28, 30 of the left and right bust cups 12, 14 are supported by the support straps 36, 38. In addition, the circumferentially outermost edges of the left and right bust cups 12, 14 are firmly fixed to the attachment edges 16, 18 of the left and right side body panels 20, 22 which in turn, encircle the body of the wearer and are fastened thereabout. Finally, the lower edges of the left and right bust cups 12, 14 are each and separately fastened to inner and outer diaphragm bands 40, 42 which diaphragm bands have their lower, substantially straight edges fixed to one another and their circumferentially outermost edges, in turn, fixed to the attachment edges 16, 18 of the side body panels 20, 22.

Further, the present invention, in addition to providing the required uplift and support by virtue of the interconnection of the elements noted hereinbefore, provides such uplift and support while permitting compensation for unsymmetrical movement of the wearer of the brassiere 10. This latter feature is provided by virtue of the lack of any direct interconnection between the left and right bust cups 12, 14; and, by virtue of the manner of attachment of the bust cups 12, 14 to the inner and outer diaphragm bands 40, 42 and by virtue of their connection to the side body panels 20, 22 only through a distance equal to approximately one bust cup (see FIG. 2).

As may be most clearly seen by reference to FIG. 2, and as noted hereinbefore, each of the inner and outer diaphragm bands 40, 42 is fashioned of two upwardly concave left and right segments 40*a*, 40*b* and 42*a*, 42*b*, respectively.

In each instance the respective left and right bust cups 12, 14 are fastened to the closest circumferentially outmost, upwardly concave edge of the diaphragm band 40, 42 and the other, circumferentially opposite upwardly concave edge of the segment 40*b*, 42*a* is fixed to the opposite side of the left and right side body panels 20, 22.

This method of attachment firmly anchors one side of each bust cup to a side body panel and anchors the other side of the bust cup to a side body panel circumferentially removed therefrom a distance equal to the circumferential distance of a single bust cup.

The aforementioned anchorage is accomplished through the medium of an elastic diaphragm band which stretches to accommodate even unsymmetrical movements of a wearer of the brassiere 10 of the present invention. Such independence of movement would not be possible without such "connection-at-a-distance" wherein the part of the bust cup spaced from the attachment edge of the side body panel to which it is attached was not spaced a distance circumferentially equal to the circumferential length of a single bust cup.

Similarly, in the present invention, such independent compensation for non-symmetrical movement is aided by lack of any direct interconnection between the left and right bust cups 12, 14, thereby permitting the wearer to engage in reaching, bending and like activities of a non-symmetrical nature while providing the required uplift and support and providing a degree of comfort previously unattainable with any of the brassieres of the prior art.

As alluded to hereinbefore, the smooth, unbroken curve which exists by virtue of the construction and arrangement of the inner and outer diaphragm bands 40, 42 and the upper left and right bust cup sections 28, 30 further aids in the comfort combined with uplift and support provided by the brassiere 10 of the present invention when the wearer thereof engages in non-symmetrical movements.

The aforementioned continuous, smooth curved relation between the diaphragm bands and upper bust cup segments, in combination with the aforementioned manner of attachment of the straps 36, 38 of the bust cup, and the lack of direct connection between the left and right bust cups 12, 14 further increases the wearer's comfort by virtue of non-symmetrical movements being compensated for by the brassiere 10 of the present invention whereby independent movement of the left and right bust cups 12, 14 is permitted. The aforementioned arrangement permits force exerted by such unsymmetrical movement to be transmitted to the affected strap; and from the strap through the affected one of the generally upstanding sections **28*b* or 30*b***, to be directed to the bust cup and therefrom directly to the side body panel circumferentially most distant from the bust cup, thereby permitting accommodation for the unequal strain through the connected diaphragm band without affecting the other bust cup.

The aforementioned lack of interconnection between the bust cups 12, 14 permits the movement thereof while the fixing of the circumferentially outermost segment of the bust cup to the circumferentially most distant side body panel through such a great distance (approaching the circumferential distance of one bust cup) permits accommodation and compensation for the symmetrical movement by the affected diaphragm band, without disturbing the unaffected bust cup from its normal position.

Naturally, certain equivalent structures can be substituted for those described with particularity in the presently preferred embodiment while still being encompassed within the scope of the present invention. For example, the left and right bust cups 12, 14 can be fashioned of one piece rather than from the upper and lower sections stitched together as illustrated in the present embodiment.

Further, the side panels 20, 22 can be fashioned from one piece and, if it is desired, the side panels 20, 22 and the front diaphragm band 42 can be fashioned in one piece and the rear diaphragm band 40 stitched to the bottom thereof to extend across the front of the brassiere and underlie the two bust cups 12, 14.

Accordingly, as will be readily apparent to those skilled in the art, the invention may be used in other specific forms without departing from its spirit or essential characteristics. The present embodiment is, therefore, to be considered as illustrative and non-restrictive, the scope of the invention being indicated by the claims rather than by the foregoing description, and all changes which come within the meaning and range of equivalence of the claims are therefore intended to be embraced therein.

What is claimed is:

1. A brassiere comprising left and right bust cups and left and right side body panels, each of said side body panels being fixed to a respective one of said bust cups, said brassiere including inner and outer diaphragm bands underlying both of said bust cups, each of said diaphragm bands being fixed to both of said respective side body panels at the proximate circumferential location wherein each of said side body panels are fixed to said respective bust cups, said inner diaphragm band being fixed to a first one of said bust cups and being free of a second one of said bust cups, said outer diaphragm band being fixed to the second one of said bust cups and being free of the first one of said bust cups, each of said inner and outer diaphragm bands including a substantially straight lower edge, said diaphragm bands being fixed to one another along said lower edge.

2. The invention according to claim 1 wherein said inner and outer diaphragm bands each includes two upwardly concave upper edges intersecting substantially centrally of said brassiere at an apex, said inner diaphragm band being fixed to said first one of said bust cups along the closer one of said upwardly concave edges, the other of said upwardly concave edges of said inner diaphragm band underlying and being free of said second one of said bust cups, said outer diaphragm band being fixed to the second one of said bust cups along the one of said upwardly concave edges of said second diaphragm band adjacent said other upwardly concave edge of said inner diaphragm band, said other upwardly concave edge of said outer diaphragm band underlying and being free of said first one of said bust cups.

3. The invention according to claim 1 wherein said diaphragm bands are fashioned of stretchable material.

4. A brassiere comprising left and right bust cups and left and right side body panels wherein each of said side body panels is fixed to a respective one of said bust cups, said brassiere including stretchable inner and outer diaphragm bands, each of said diaphragm bands being fixed to the underside of one of said bust cups and being free of the other one of said bust cups, both of said diaphragm bands being fixed to said brassiere at the outer circumferential sides of both of said bust cups, said diaphragm bands including a substantially straight lower edge and being fixed to one another along said lower edge.

5. The invention according to claim 4 wherein said inner and outer diaphragm bands each includes an upper edge with two generally upwardly concave segments intersecting at an apex, each of said apices being substantially centrally located relative to said circumference of said brassiere, said bust cups being fixed to said respective diaphragm bands at one of said upwardly concave segments and being constructed and arranged so that a circumferentially inner edge of each of said bust cups and the non-attached upwardly concave segment of each of said respective diaphragm bands forms a smooth, continuous line, thereby fixing each of said respective bust cups to the circumferentially opposite side body panel by virtue of interconnection of said respective diaphragm band therewith.

* * * * *